US009056750B2

(12) United States Patent
Ge et al.

(10) Patent No.: US 9,056,750 B2
(45) Date of Patent: Jun. 16, 2015

(54) ESCALATOR HANDRAIL CHAIN

(75) Inventors: Wei Ge, Haining (CN); Weifeng Shao, Hangzhou (CN); MingPing Jiang, Hangzhou (CN); Jun Li, Hangzhou (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 15 days.

(21) Appl. No.: 13/516,809

(22) PCT Filed: Jan. 13, 2011

(86) PCT No.: PCT/US2011/021059
§ 371 (c)(1),
(2), (4) Date: Jun. 18, 2012

(87) PCT Pub. No.: WO2011/075749
PCT Pub. Date: Jun. 23, 2011

(65) Prior Publication Data
US 2012/0279827 A1 Nov. 8, 2012

(51) Int. Cl.
*B66B 23/04* (2006.01)
*B66B 23/24* (2006.01)

(52) U.S. Cl.
CPC ..... *B66B 23/04* (2013.01); *B66B 23/24* (2013.01)

(58) Field of Classification Search
CPC ..... B66B 23/24
USPC ..... 198/335, 337, 321
See application file for complete search history.

(56) References Cited

U.S. PATENT DOCUMENTS

| | | | | |
|---|---|---|---|---|
| 4,467,913 | A * | 8/1984 | Salloum | 198/687 |
| 5,160,009 | A * | 11/1992 | Iyoda et al. | 198/337 |
| 5,477,954 | A | 12/1995 | Greutter et al. | |
| 7,600,628 | B2 * | 10/2009 | Gonzalez Alemany et al. | 198/334 |

FOREIGN PATENT DOCUMENTS

| | | | |
|---|---|---|---|
| JP | 48-87584 | A | 11/1973 |
| JP | 2003221178 | A | 8/2003 |
| JP | 2008184241 | A | 8/2008 |

OTHER PUBLICATIONS

Notification of Transmittal of the International Search Report and Written Opinion of the International Searching Authority; PCT/US2011/021059; Mailed Aug. 11, 2011; Korean Intellectual Property Office; 9 pages.

* cited by examiner

*Primary Examiner* — Gene Crawford
*Assistant Examiner* — Lester Rushin
(74) *Attorney, Agent, or Firm* — Cantor Colburn LLP

(57) ABSTRACT

A handrail assembly for an escalator system includes a handrail movable along a length of the escalator and a handrail guide assembly defining a travel path for the handrail. The handrail guide assembly includes a handrail guide and a plurality of sliding bearing supports interconnected to form a handrail chain and secured to the handrail guide. One or more sliding bearings extend at least partially through each sliding bearing support of the handrail chain. A shaft extends through each sliding bearing support and is in sliding contact with the one or more sliding bearings. One or more rollers are secured to at least one end of the shaft and is in rolling contact with the handrail.

12 Claims, 1 Drawing Sheet

ESCALATOR HANDRAIL CHAIN

BACKGROUND OF THE INVENTION

The subject matter disclosed herein relates to escalators, travelators, moving ramps, and the like. More specifically, the subject disclosure relates to handrail guide mechanisms for escalators, travelators, moving ramps, and the like.

Escalator systems typically include a handrail, often two handrails that travel along with a plurality of pallets that make up the escalator system. The handrail travels over a handrail guide which is fixed to a balustrade of the escalator system. In guiding the handrail, it is desired that the handrail guide reduce the frictional resistance of travel of the handrail over the handrail guide to reduce wear and also prevent unwanted noise in the handrail. Typically, three approaches are taken in reducing the resistance. First, the handrail guide material may be changed to a low-friction material. Second, coatings may be added to the handrail or handrail guide. Finally, a chain including rolling elements, such as roller bearings, may be added between the handrail guide and the handrail. The chain is fixed to the handrail guide, with the roller bearings contacting the handrail. This results in a rolling contact, and rolling friction between the handrail and handrail guide, which is less detrimental than a sliding friction which results from direct contact between the handrail and the handrail guide.

The typical handrail including the roller bearing chain, however, generates undesirable noise during operation for at least two reasons. First, the sealing of the roller bearing breaks down causing lubricant to leak therefrom resulting in dry rubbing which generates noise. Second, when the roller bearing chain is subjected to a side force, the roller bearings contact and rub against the handrail guide generating noise. Further, when sealing of the roller bearings is damaged, contaminants enter the roller bearings. As a result, the roller bearings stop rotating generating heat between the roller bearings and the handrail, thus reducing the useful life of the handrail.

BRIEF DESCRIPTION OF THE INVENTION

According to one aspect of the invention, a handrail assembly for an escalator system includes a handrail movable along a length of the escalator and a handrail guide assembly defining a travel path for the handrail. The handrail guide assembly includes a handrail guide and a plurality of sliding bearing supports interconnected to form a handrail chain and secured to the handrail guide. One or more sliding bearings extend at least partially through each sliding bearing support of the handrail chain. A shaft extends through each sliding bearing support and is in sliding contact with the one or more sliding bearings. One or more rollers are secured to at least one end of the shaft and are in rolling contact with the handrail.

According to another aspect of the invention, a handrail chain for an escalator system includes a plurality of sliding bearing supports interconnected to form a handrail chain. One or more sliding bearings extend at least partially through each sliding bearing support of the handrail chain. A shaft extends through each sliding bearing support and is in sliding contact with the one or more sliding bearings. One or more rollers are secured to at least one end of the shaft and are in rolling contact with a handrail.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
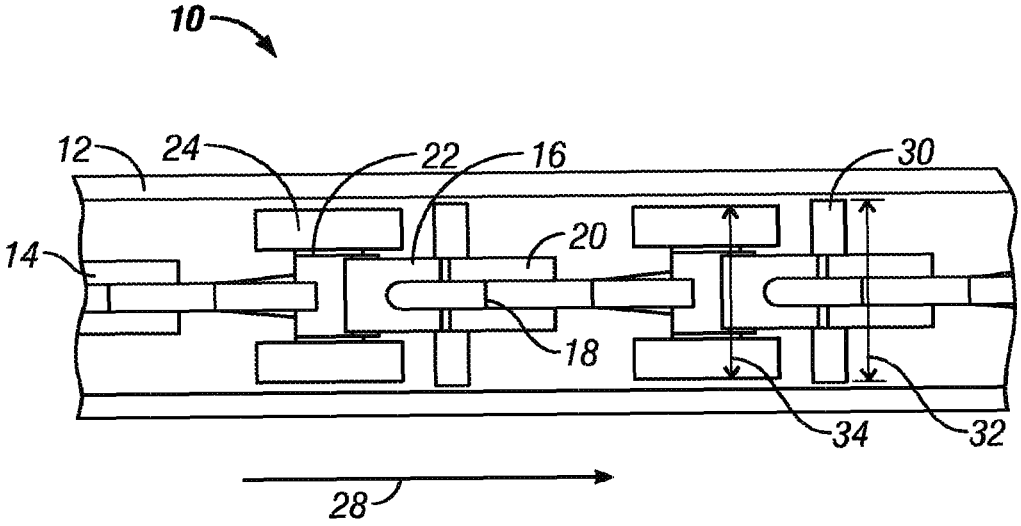
FIG. 1 is a plan view of an embodiment of a handrail assembly.

Shown in FIG. 1 is a plan view of a handrail assembly 10 for an escalator, travelator, moving ramp, or the like. The handrail assembly 10 includes a handrail guide 12, formed from sheet metal or the like, and a handrail chain 14 secured to the handrail guide 12. The handrail chain 14 is formed from a plurality of sliding bearing supports 16 which are joined by linking a head end 18 of one sliding bearing support 16 to a tail end 20 of an adjacent sliding bearing support 16. The sliding bearing support 16 supports a sliding bearing 22 and one or more rolling members 24. The one or more rolling members 24 are interactive with a handrail 26 (shown in FIG. 2) to reduce a friction of movement of the handrail 26 along the handrail guide 12 in a handrail drive direction 28. One or more bosses 30 extend laterally from the sliding bearing support 16. The bosses 30 extend laterally a boss width 32 which is greater than a rolling member lateral span 34. This feature operates when the handrail chain 14 is subjected to side loads which try to force the handrail chain 14 toward a wall of the handrail guide 12. Under such loads, the boss 30, due to its extended boss width 32, will contact the handrail guide 12 before the rolling members 24 contact the handrail guide 12, and essentially act as a stop to prevent the rolling members 24 from contacting the handrail guide 12. This prevents the undesired noise from rolling member contact with the handrail guide of the prior art.

Figure 2:
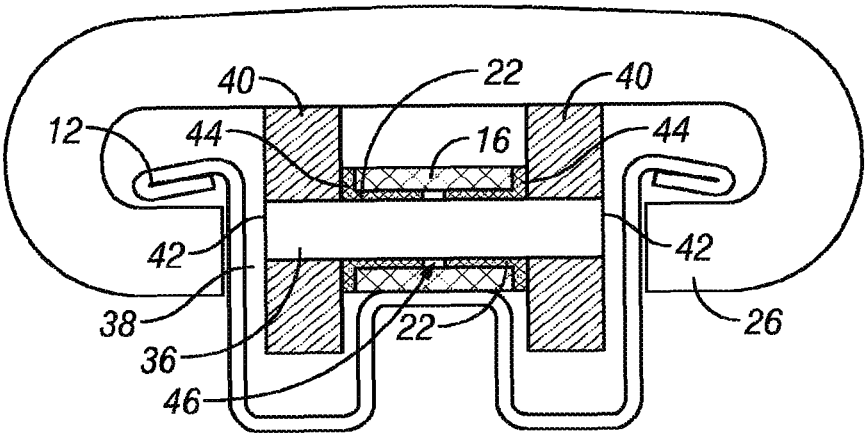
FIG. 2 is a cross-sectional view of an embodiment of a handrail assembly

Referring now to FIG. 2, the rolling member 24 and sliding bearing 22 will be discussed in more detail. As shown, two sliding bearings 22 are disposed in the sliding bearing support 16. A shaft 36 extends through the two sliding bearings 22 and is configured to have a sliding friction relationship between the shaft 36 and the sliding bearings 22 when the shaft is rotated about a shaft axis 38. Rollers 40 are fixed to each shaft end 42, and rotate about the shaft axis 38 with the shaft 36. The rollers 40 are in contact with the handrail 26 and provide the reduction in friction via the rotation of the rollers 40 and shaft 36 through the sliding action of the shaft 36 relative to the sliding bearings 22. In some embodiments, the sliding bearings 22 are lubrication-free bearings and have a bearing flange 44 that abuts the roller 40. In other embodiments, lubrication can be added between the bearing flange 44 and the roller 40. As shown in FIG. 2, two sliding bearings 22 are included, and have a bearing gap 46 at the shaft 36 between the two sliding bearings 22. In some embodiments, lubrication may be included in the bearing gap 46. In other embodiments, there is no bearing gap 46, and the two sliding bearings 22 substantially abut. In still other embodiments, only one sliding bearing 22 is utilized, which may extend entirely across the sliding bearing support 16.

In utilizing the arrangement described above, the rolling of the rollers 40 on the handrail chain 14 is realized via sliding motion of the shaft 36, and in some embodiments, the rollers 40, relative to the sliding bearings 22. This reduces noise and rough operation relative to the prior art handrails utilizing roller bearings. Further, since in some embodiments the sliding bearings are self-lubricating, heating of the handrail can be reduced thereby extending the life of the handrail compared to that of the prior art.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A handrail assembly for an escalator system comprising:

a handrail movable along a length of the escalator;

a handrail guide assembly defining a travel path for the handrail including:

a handrail guide;

a plurality of sliding bearing supports interconnected to form a handrail chain and secured to the handrail guide;

one or more sliding bearings extending at least partially through each sliding bearing support of the handrail chain;

a shaft extending through each sliding bearing support and in sliding contact with the one or more sliding bearings;

a plurality of rollers secured to at least one end of the shaft and in rolling contact with the handrail; and a boss extending laterally from the sliding bearing support and disposed longitudinally entirely between a first roller of the plurality of rollers and a second roller of the plurality of rollers relative to a length of the handrail assembly, the first roller and second roller having no additional rollers disposed longitudinally therebetween, the boss extending beyond a lateral extent of the rollers.

2. The handrail assembly of claim 1, wherein the one or more sliding bearings are two sliding bearings at least partially extending through each sliding bearing support.

3. The handrail assembly of claim 2, including a gap between the two sliding bearings.

4. The handrail assembly of claim 3, including lubricant applied in the gap.

5. The handrail assembly of claim 1, wherein the one or more sliding bearings is a single unitary bearing extending entirely through the sliding bearing support.

6. The handrail assembly of claim 1, wherein each sliding bearing includes a bearing flange substantially abutting the one or more rollers.

7. A handrail chain for an escalator system comprising:

a plurality of sliding bearing supports interconnected to form a handrail chain;

one or more sliding bearings extending at least partially through each sliding bearing support of the handrail chain;

a shaft extending through each sliding bearing support and in sliding contact with the one or more sliding bearings;

a plurality of rollers secured to at least one end of the shaft and in rolling contact with a handrail; and a boss extending laterally from the sliding bearing support and disposed longitudinally entirely between a first roller of the plurality of rollers and a second roller of the plurality of rollers relative to a length of the handrail chain, the first roller and the second roller having no additional rollers disposed longitudinally therebetween, the boss extending beyond a lateral extent of the rollers.

8. The handrail chain of claim 7, wherein the one or more sliding bearings are two sliding bearings at least partially extending through each sliding bearing support.

9. The handrail chain of claim 8, including a gap between the two sliding bearings.

10. The handrail chain of claim 9, including lubricant applied in the gap.

11. The handrail chain of claim 7, wherein the one or more sliding bearings is a single unitary bearing extending entirely through the sliding bearing support.

12. The handrail chain of claim 7, wherein each sliding bearing includes a bearing flange substantially abutting the one or more rollers.

* * * * *